United States Patent [19]

Reichel

[11] Patent Number: 4,981,164

[45] Date of Patent: Jan. 1, 1991

[54] PARTITION FOR SHOWERS

[76] Inventor: Gunter Reichel, Kreuzstrasse 19, D-3563 Dautphetal 5, Fed. Rep. of Germany

[21] Appl. No.: 472,226

[22] Filed: Jan. 30, 1990

Related U.S. Application Data

[63] Continuation of Ser. No. 826,603, Feb. 6, 1986, abandoned.

[30] Foreign Application Priority Data

Feb. 15, 1985 [DE] Fed. Rep. of Germany ..... 3505219

[51] Int. Cl.[5] ..... A47K 3/22

[52] U.S. Cl. ..... 160/187; 160/199; 4/557; 4/607; 4/610

[58] Field of Search ..... 4/557, 607, 610, 612, 4/614; 160/201–207, 211, 213, 186, 187, 197, 199

[56] References Cited

U.S. PATENT DOCUMENTS

| | | | |
|---|---|---|---|
| 1,282,146 | 10/1918 | Tomkinson | 160/211 X |
| 4,014,378 | 3/1977 | Kochanowski | 160/186 |
| 4,256,164 | 3/1981 | Agcaoili | 160/186 |
| 4,276,919 | 7/1981 | Walters | 160/206 |
| 4,606,081 | 8/1986 | Baus | 4/610 |

FOREIGN PATENT DOCUMENTS

| | | | |
|---|---|---|---|
| 2325032 | 12/1974 | Fed. Rep. of Germany | 4/557 |
| 3427911 | 10/1985 | Fed. Rep. of Germany | 4/610 |
| 625345 | 4/1927 | France | 160/211 |

*Primary Examiner*—Charles E. Phillips
*Attorney, Agent, or Firm*—Fred Philpitt

[57] ABSTRACT

The invention relates to a partition (19) having horizontal guide rails (14, 14') held between lateral stops (16) and including three collapsible door panels (18, 20, 22) adapted to be moved to and from either side. The middle panel (20) is offset to the front and is articulated to one outer panel (22), whereas a groove (36) is provided on the upper edge of the middle panel for guiding a slidable articulation (28) attached to the other outer panel (18). An opener (40) having two lever arms (42, 48) is mounted to the articulation (30) and will be pivoted as the slidable articulation (28) passes, a long lever arm (48) engaging a slide face (52) of a joint crown (50). Magnetic gibs (60) are provided on the lateral stops (16) and on ledges (58) of the adjacent vertical edges (56) of the outer panels (18, 22). Preferably ball-boren rollers (66) support the door panels along the upper guide rail (14).

15 Claims, 5 Drawing Sheets

22
70
V
50
30
52
72
48
40
46
44
42
74
28
54
18
36
20
II
IV
I
VI
III
58'
67
68
66
58
82
84
90
88
86

PARTITION FOR SHOWERS

This is a continuation of application Ser. No. 826,603, filed Feb. 6, 1986 now abandoned and the benefits of 35 USC 120 are claimed relative to it.

FIELD OF THE INVENTION

The invention relates to a partition for showers. It serves to confine the shower space and to provide splash protection.

BACKGROUND OF THE INVENTION

Conventional shower partitions such as disclosed in DE-OS No. 28 56 171 and DE-OS No. 33 06 419 comprise a plurality of door panels which are articulated at their respective adjacent vertical edges. An outer door panel is joined to a wall fixture. When closed, the door panels form a flush partition; they fold inside when opened. With a two-part sliding hinged door according to DE-GM No. 83 32 451, the door panels are also in flush alignment when closed. The same holds for collapsible doors as described in DE-AS No. 28 54 083 and DE-OS No. 30 08 826 which include special articulations and sealing elements.

In the erection of shower partitions, it may happen that the actual conditions on a site require a door articulation to be mounted to a certain side whereas it would be much better for later use if opening and closing in the opposite direction were possible. Frequently the needs of the user(s) cannot be properly taken into consideration. Therefore, a design would be welcomed that permits adaptation to various local conditions.

OBJECTS OF THE INVENTION

It is an important object of the invention to improve shower partitions as economically as possible such that both mounting and use are independent of the opening and closing directions.

Another object of the invention is to achieve facilitated handling of partition sections by whatever user.

A further object of the invention consists improving the shower partition design so as to dispense with a lateral permanent connection of an outer door panel to a wall or post.

SUMMARY OF THE INVENTION

It is distinctive for the invention that the partition comprises three door panels which can be moved to and from either side between lateral walls or posts. The three panels are all slidable and foldable so that remarkable advantages result for arrangement and use. In any case, there is no need for an articulation of an outer door panel to a lateral wall or post. Consequently, lateral fastening brackets or other conventional fixing means are dispensed with. This leads to more economy and, in particular, to much easier use. For the first time, it does not matter if the partition be opened at the righthand or lefthand side. In accordance with the invention, both directions are possible and they are equally free outside, i.e. if the user is in front of the partition, and inside the shower cubicle.

SPECIALIZATIONS OF THE INVENTION

The invention provides for a three-panel partition whose middle panel is either recessed or salient relative to the side panels. Thus the requirement of a partition having flush panels when closed is dropped, enabling a considerable simplification of design. The middle panel may carry a decoration that is different from the appearance of the side panels; for instance, a mirror may be attached to the middle panel which may also be wider than the outer panels. In that case, its wider frame is a component particularly well suited for the mechanical connection.

An important feature of the invention is that the middle panel is connected to one side panel by an articulation and to the other side panel by a slidable articulation. This structure differs fundamentally from the conventional designs. It allows for pivoting and sliding of either outer panel relative to the middle panel during the folding motion thereof. Such movement was impossible according to the prior art which permitted only parallel sliding or pivoting around an articulation. Here, the invention goes far beyond the state of the art in that it provides simple means for combining both motions.

Further embodiments, modifications, details and advantages of the invention will become evident from the annexed drawings wherein.

Figure 3:
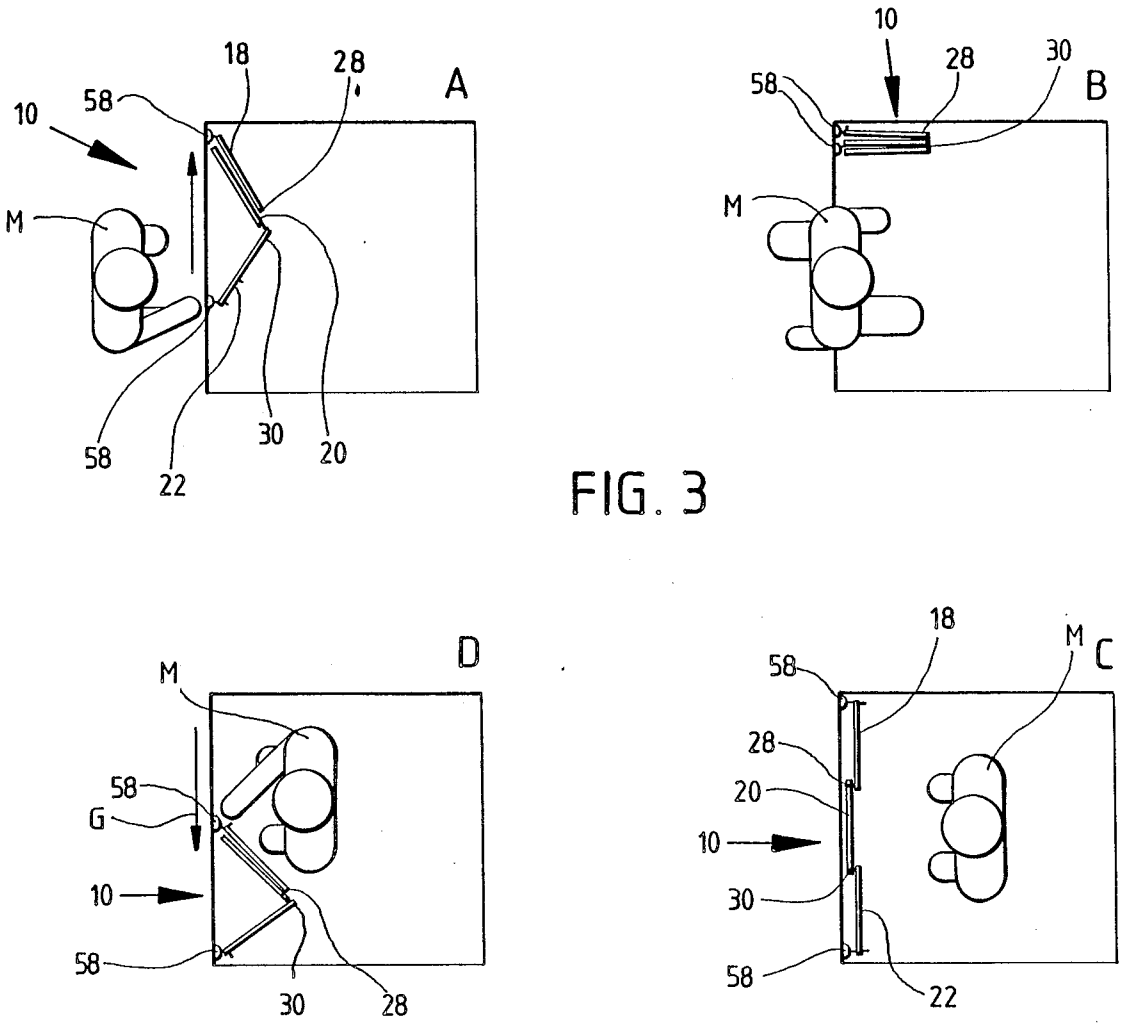
Figures 4, 4A, 5:
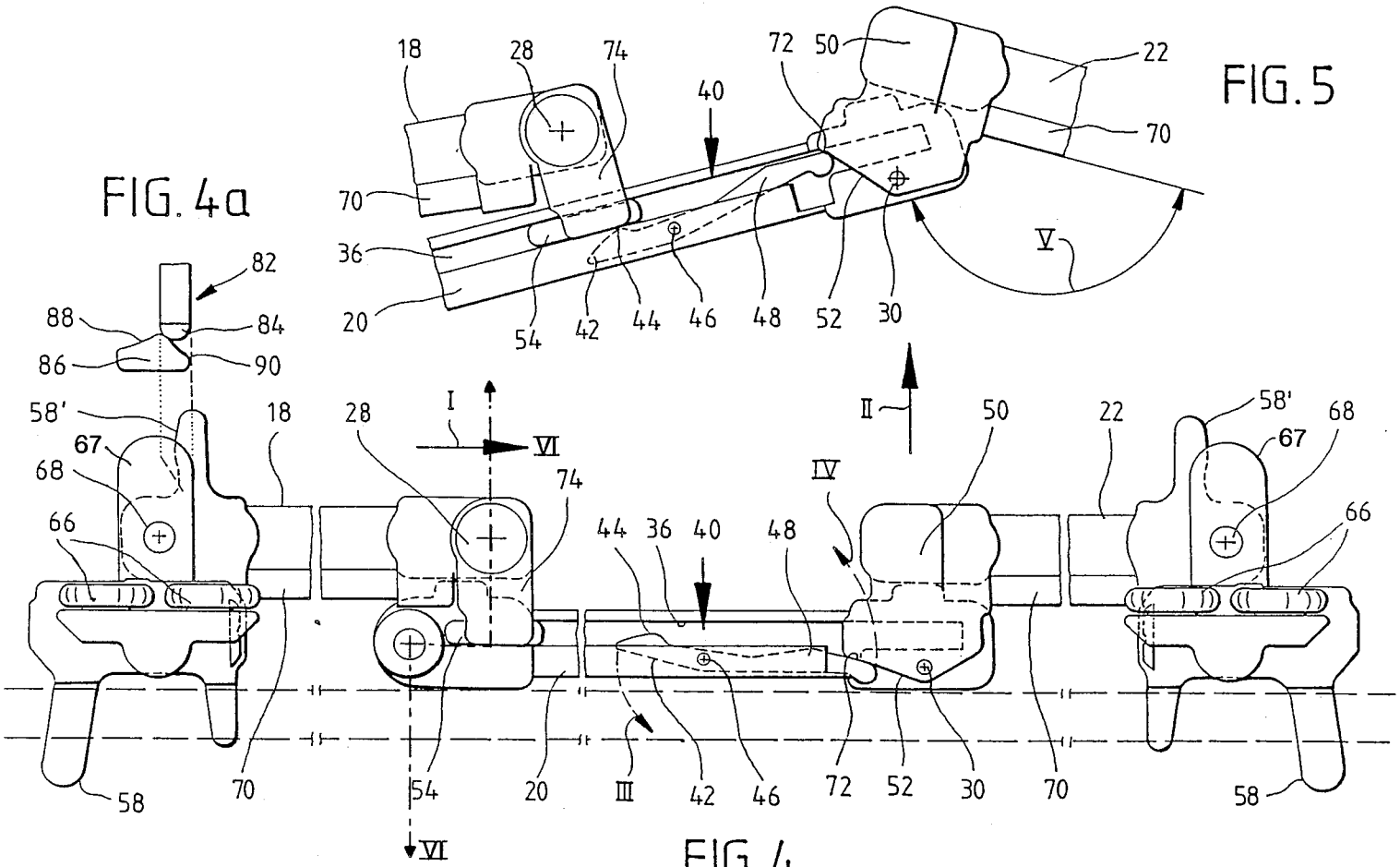
Figure 6:
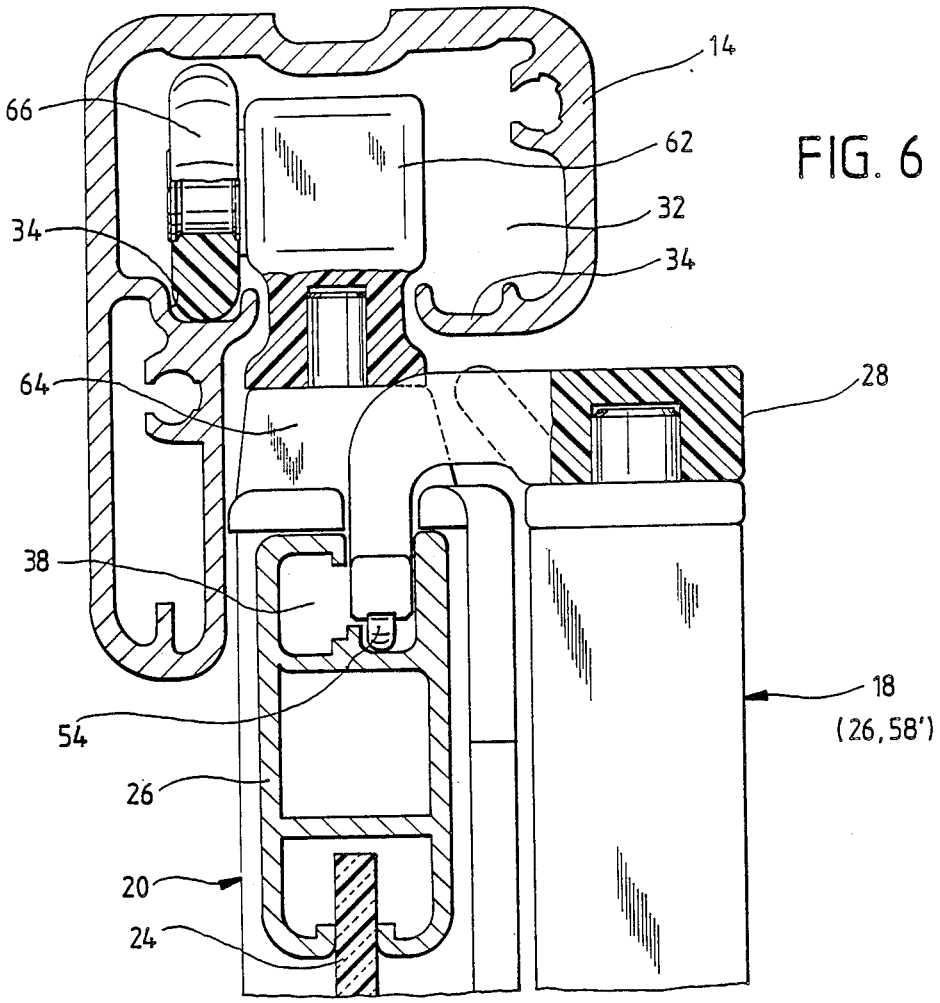
Figure 6A:
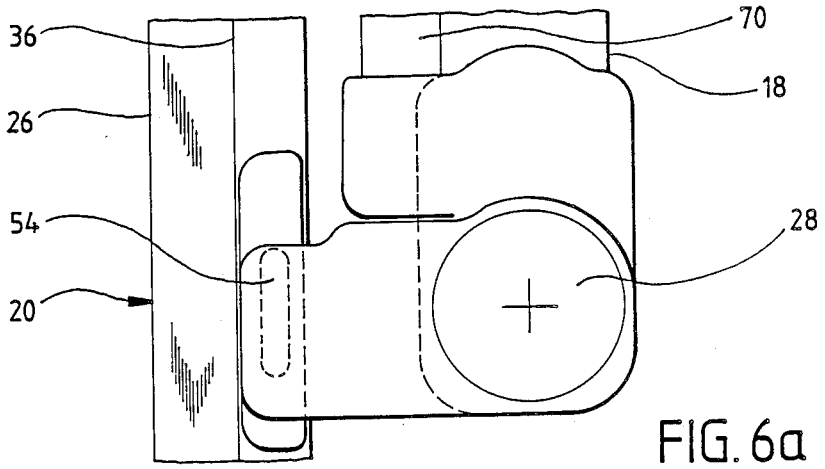
Figure 7:
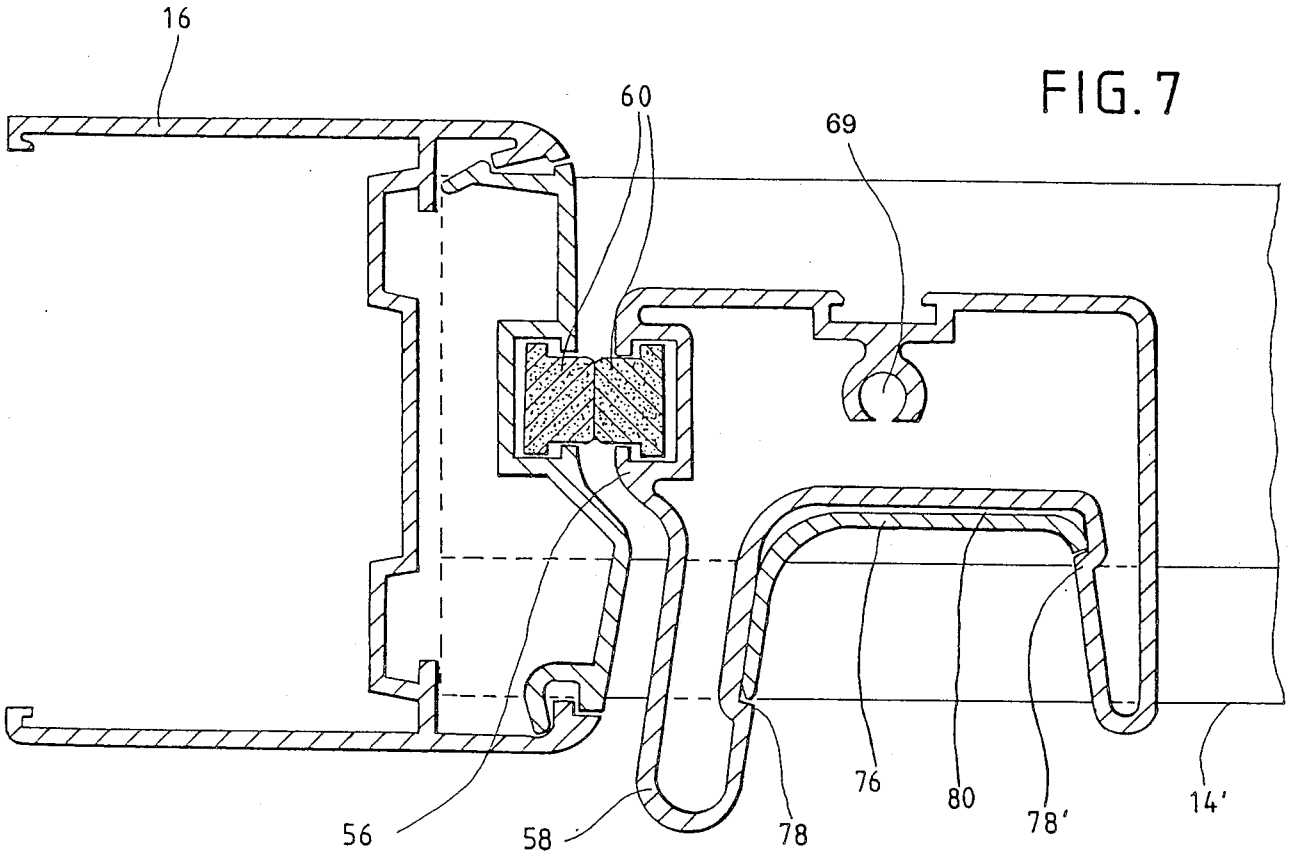

FIG. 3 comprises four diagrammatic top views of a shower partition in various positions of use, FIG. 4 is a top view of an articulation structure of a closed shower partition, FIG. **4*a* is a part elevation of a locking device, FIG. 5 is a part elevation similar to FIG. 4 in an opening phase, FIG. 6 is a sectional view of a door panel support, FIG. 6*a* is a part top view of the support shown in FIG. 6, and FIG. 7** is a sectional view with a lateral post and a handle component including sealing means.

DESCRIPTION

Figure 1:
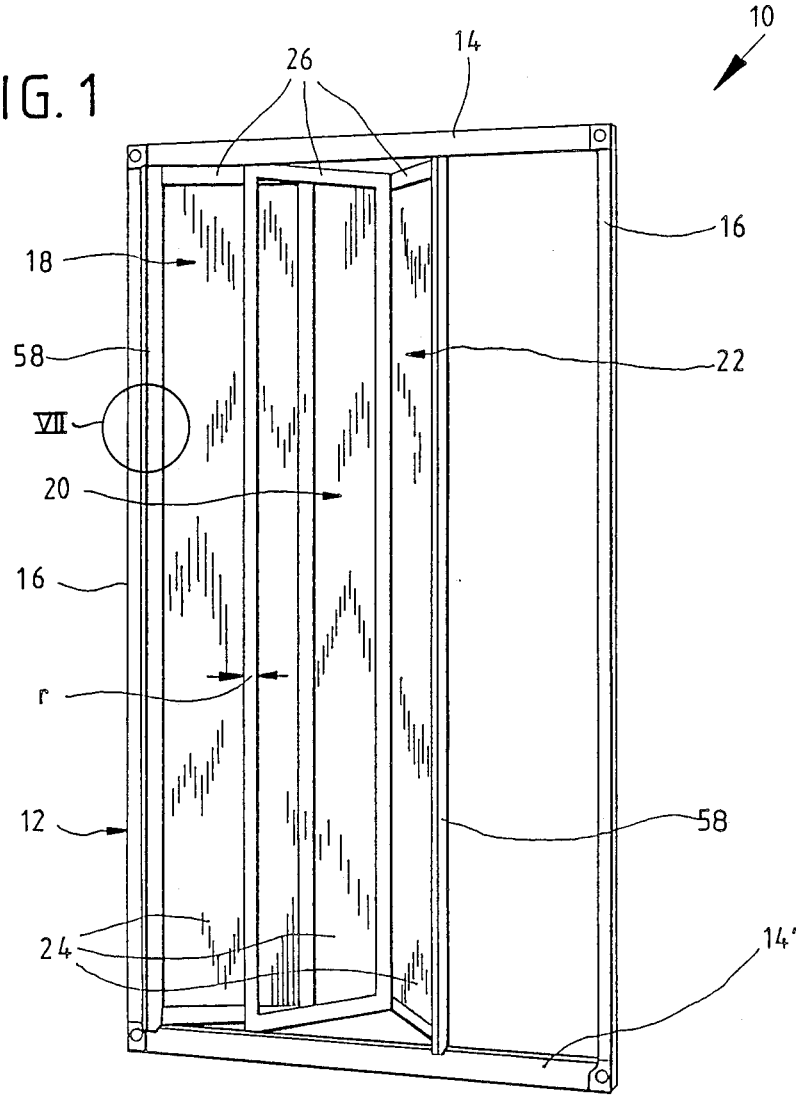
FIG. 1 is a schematic perspective view of a shower partition.

A partition as shown in FIG. 1 is designated by reference 10 and is depicted per se, i.e. without attachment to a wall. It may be mounted to a bath tub, a shower cubicle or the like. A profiled frame 12 comprises an upper guide rail 14 as well as a lower guide rail 14' and lateral stops 16 which may be posts, wall parts, etc. Three door panels or segments 18, 20, 22 are provided, each of which includes a transcluent area 24 and a frame profile 26.

Figure 2:
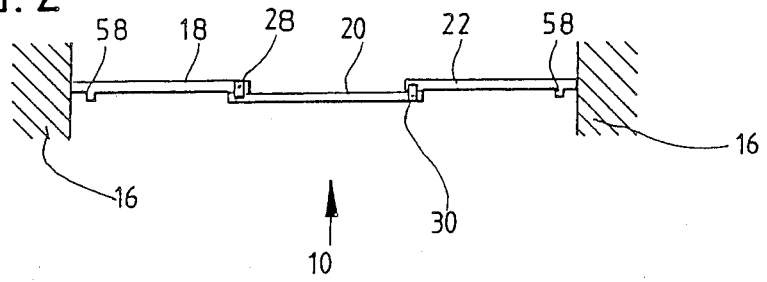
FIG. 2 is a more schematic top view of a shower partition.

As will be seen from FIG. 2, the middle panel 20 is projecting relative to the side panels 18, 22 when the partition 10 is closed. Alternatively, middle panel 20 may be recessed relative to the outer panels 18, 22 on either side. Each of the latter panels comprises a handle or shoulder ledge 58, arranged at the side of the respective stop 16. The lefthand door panel 18 is connected to the middle panel 20 by a slidable articulation 28; middle panel 20, in turn, is connected to the righthand door panel 22 by an articulation 30. This assembly permits a combined sliding and folding motion of which an intermediate position is shown in FIG. 1.

A typical mode of use will be evident from FIG. 3 wherein part A shows an outline of a user M who opens the partition 10 by reaching with his right hand to the righthand handle 58 in order to push the righthand door panel 22 in direction R, i.e. towards the left. During this movement, the slidable articulation 28 passes along the upper edge of middle door panel 20 which folds together with the side panels 18, 22 at the same time. Part B of FIG. 3 shows the collapsed position where partition 10 has been fully pushed to the left. User M can conveniently enter the shower cubicle and close the partition 10, which position is seen in FIG. 3 (C). Part D of the figure shows that partition 10 can be opened in counterdirection G; user M grasps, again with the right hand, handle 58 (which is lefthand as viewed from the outside) in order to push the door panel 18 aside. When fully opened, the partition 10 would be folded as shown in part B, but at the opposite side.

Since the partition 10 can be opened towards and closed from either side, the direction of operation is immaterial. The preceding explanation by way of FIG. 3 refers to a typical right-handed person. It will be evident that opening might as well be done in counterdirection G, and closing in direction R, as a left-hander would automatically do. At no time any user is compelled to operate the partition 10 in a given direction, whether he or she be inside the shower cubicle or in front of it. In any case there is plenty of room inside even during the folding motion of the door panels since the articulations 28, 30 move towards the innermost corner so that maximum freedom of movement is warranted to the user M.

The structure and function of the articulation arrangement is now explained by way of FIGS. 4 and 5 wherein the door panels 18, 20, 22 are shortened for drawing economy. It is seen that slidable articulation 28 comprises an arm 74 with a plunger 54 that slides in a guiding groove 36 on the upper edge of the frame profile 26 of the middle panel 20. In a free space 38 (FIG. 6) of said profile, there is an opener 40 which can be pivoted within an angular range around the axis of a bearing 46. Opener 40 has two lever arms 42, 48 of different length arranged at an obtuse angle to each other. The short lever arm 42 includes a tappet 44 engaged for operation by the plunger 54 of slidable articulation 28. The end of the long lever arm 48 engages a joint crown 50 of the articulation 30 which links the righthand door panel 22 to the middle panel 20. Joint crown 50 comprises a slide face 52 which is vertical but slants relative to the guiding groove 36. One end of the slide face 52 winds up to form a run-in contour 72.

In operation, the partition 10 initially closed as shown in FIG. 4 is opened by pushing the lefthand door panel 18 in the direction indicated by arrow I. Thereby, slidable articulation 28 is advanced along the guiding groove 36 on the upper edge of the middle panel frame profile 26. Reaching tappet 44 of opener 40, arm 74 with its plunger 54 forces the short lever arm 42 back into the free space 38 of frame profile 26. Consequently, opener 40 is pivoted around the axis of bearing 46 in the direction of arrow III so that the long lever arm 48 engages the slide face 52 of the joint crown 50 at the articulation 30, folding the door panels 20, 22 in the general direction of arrows II and V (FIG. 5) to an angular position of, say, about 140 degrees while the end of long lever arm 48 engages the run-in contour 72 of slide face 52, effecting a motion in the direction of arrow IV. As the lefthand door panel 18 continues to move to the right, the slidable articulation 28 travels freely to the fully open position beside articulation 30. Thus all the three door panels 18, 20, 22 are collapsed side by side, and opener 40 returns to its initial position. Its long lever arm 48 extends to the right way into the free space 38 (FIG. 6) so that arm 74 of slidable articulation 28 is prevented from passing behind opener 40, whatever its position might be. Any misaction is, therefore, excluded.

If the partition 10 is operated from the righthand side, the opening motion is laterally reversed but otherwise the same, including the movements of the components relative to each other.

For closing the partition 10, slidable articulation 28 is moved to temporarily push opener 40 into the opening position as plunger 54 passes the tappet 44. However, when the door panels move apart to flatten the angle between panels 20 and 22, the slide face 52 engages the run-in contour 72 of long lever arm 48 to return the opener 40 into its initial position.

It will be noted that the closing motion, too, requires little effort. A snap-in device 82 (FIG. 4*a*) assists this movement. The frame profile 26 of each of the side panels 18, 22 may, at least on the upper or lower edge thereof, have a dog 84 on the handle side. This dog is associated to a double gib 86 at the respective guide rail 14 and/or 14'. Said gib 86 preferably has a gentle slope 88 and an opposite steep slope 90. During the closing motion, a dog 84 at the lower panel portion runs up the gentle slope 88 and drops at the steep slope 90. Therefore, the respective door panel 18 or 22 is slightly lifted and lowered. The latter process serves to softly lock the partition 10 in its closed position.

Further details of a preferred embodiment can be gathered from FIGS. 4 and 6. The upper guide rail 14 includes tracks 34 along which supporting elements carry the door panels 18, 20, 22. On each of those, a holding member 62 is attached to the upper frame profile 26 by means of a clamp fitting 64. Holding member 62 supports a roller pair 66 (FIG. 4) that is preferably ball-borne and runs on a track 34 within space 32. The upper frame profiles 26 of the outer or side panels 18, 22 comprise a deflector 70, which may be a bent plate such as indicated in FIGS. 4 and 6*a*, projecting above the frame profile of the middle panel 20.

Towards the lateral stops 16 (FIGS. 1 and 7) each side panel 18, 20 has a shoulder ledge 58 (FIGS. 4 and 7) which is connected via a handle articulation 68 (FIG. 4) to an inner ledge 58' that, in turn, is fixed to the frame profile 26 of the respective door panel. It will be noted that the rollers 66 support the weight of the door panels and permit their shifting along the upper rail 14, whereas the handles articulated at 68 (FIG. 4) serve to enable the folding of the outer or side panels 18, 22 from the inside.

On or near the vertical edges 56 of the outer or side panels 18, 22, are included magnetic gibs 60 (FIG. 7) which are associated to corresponding magnetic gibs in the adjacent stop 16. The particular shape of the shoulder ledges 58 provides splash protection at the vertical edges 56.

FIG. 7 shows a groove 69 and further shows a vertical step or shoulder 78, 78' in each of the profiles of ledges 58 receiving a handle inset 76 such that its inner or bottom portion engages a rib 80 under spring tension. These insets 76 can be exchanged in order to obtain various decorative effects depending on the colors, patterns or finishes chosen.

Partition 10 is distinguished by affording easy care. There are no hidden surface corners or grooves. The lower guide rail 14' is a closed strip without any apertures or slots and includes a slide-roller guide. Consequently, interior guide components such as rods, grooves, holding fixtures, folding profiles, etc. are dispensed with.

The design according to the invention is especially advantageous in that one and the same door panels 18, 20, 22 can also be used in a frame 12 of lesser width. For instance, if it were required to arrange the lateral stops 16 at a clearance smaller than the span of the fully extended partition 10, suitable offset battens (not shown) may be attached to the vertical posts, walls or the like. The mode of operation and the type of motion of the door panels 18, 20, 22 will not be influenced by such measures.

If an outer panel is moved from the closed position of partition 10, opener 40 releases the folding motion of the middle panel 20. While a two-arm lever opener 40 is preferred, other configurations may also be used. Special functions may be provided for the operating and rest positions. Opposite the articulation 30, a stop motion device functioning as opener 40 may be arranged at the middle panel 20 such that the latter will be pushed aside and pivoted when a cam face or wedge at the outer panel having the slidable articulation 28 is approached. An arm (48) extending into the guide space may also constitute a stop for the associated outer panel 18 or 22.

Magnetic gibs 60 are used on either side of the partition 10 whereas before, such elements have been used merely on one entry side, e.g. in accordance with DE-GM No. 80 29 984.

Here, these gibs 60 are also substitutes for the conventional sealed joining means to a permanent vertical post, wall, rail, etc.

A further feature is that the lower guide rail 14' where the door panels 18, 20, 22 are guided by means of slide-rollers (not shown) is completely devoid of apertures, surfaces grooves, slots or the like. Thus an important source of susceptance to trouble is done away with, and maintenance is much facilitated.

Where a shower cubicle is to be entered through a corner, an entry free of posts can be provided in an extremely simple manner by joining a second partition to a like primary one in accordance with the invention.

While preferred embodiments have been illustrated and explained hereinabove, it should be understood that numerous variations and modifications will be apparent to one skilled in the art without departing from the principles of the invention which, therefore, is not to be construed as being limited to the specific forms described.

I claim:

1. A closure arrangement for an opening including in combination:

(a) horizontal top 14 and bottom 14' guide rails which are adapted to be mounted along the top and bottom of the opening, (b) vertical side stops 16 adapted to be positioned at the sides of said opening, (c) three door panels 18, 20, 22 mounted between said top and bottom guide rails 14, 14' and between said vertical side stops 16, said panels including a middle panel 20 having two vertical side edges, and two side panels 18, 22 each having both an inner vertical edge, an outer vertical edge, and a top edge, (d) first articulating means for pivotably interconnecting one vertical side edge of the middle panel with the inner vertical edge of one side panel, said first articulating means being in a fixed position relative to both said one vertical side edge of the middle panel and said inner vertical edge of said one side panel, (e) second articulating means slidably interconnecting said middle panel with said other side panel, said second articulating means being fixed with respect to said other side panel but slidable with respect to said middle panel, (f) other articulating means located adjacent the top of each outer vertical edge of said side panels, each of said other articulating means being fixed with respect to a side panel but being laterally movable with respect to said side stops, and (g) support means interconnecting the top edge of each of said side panels with said top guide rail, said support means being laterally movable along at least a portion of said top guide rail.

2. A closure arrangement according to claim 1 wherein said three panels are arranged to be shiftable and foldable between said vertical side stops to and from either side thereof, said first articulating means being a pivotable articulation and said second articulating means is a slidable articulation, and wherein said middle panel includes an upper frame profile with a guiding groove to facilitate slidable articulation.

3. A closure arrangement according to claim 2 wherein said pivotable articulation is adjacent to an opener adapted to be operated by means of said slidable articulation, wherein said pivotable articulation includes a slide face and wherein said opener is pivotable and comprises adjacent said pivotable articulation, a long lever arm engaging said slide face.

4. A closure arrangement according to claim 1 wherein said middle panel is either recessed or salient relative to both side panels and is wider than said side panels.

5. A closure arrangement according to claim 3 wherein said opener is a two-arm lever and is supported by a bearing in a free space in an upper portion of said middle panel.

6. A closure arrangement according to claim 3 wherein the opener includes, opposite said pivotable articulation, a short lever arm with a tappet adapted to be engaged by a plunger of said slidable articulation.

7. A closure arrangement according to claim 3 wherein said pivotable articulation includes a joint crown bearing against said slide face which is vertical, slides relative to said guiding groove and has a run-in contour at one end.

8. A closure arrangement according to claim 3 wherein said slidable articulation comprises an arm that projects into said guiding groove and forms a stop to said associated side panel.

9. A closure arrangement according to claim 1 wherein said support means comprises rollers borne by holding members in a space of said top guide rail and wherein each holding member is attached to the top of one of said side panels.

10. A closure arrangement according to claim 1 wherein said two side panels include sliding components for guiding them laterally along said top guide rail.

11. A closure arrangement according to claim 1 wherein the bottom of each side panel includes a slide roller to engage said bottom guide rail.

12. A closure arrangement according to claim 1 wherein said side stops and the vertical panel edges facing them are provided with magnetic sealing means.

13. A closure arrangement according to claim 1 wherein each of the side panels includes adjacent their outer vertical edges at least one handle.

14. A closure arrangement according to claim 13 wherein an inner shoulder ledge is provided at the top and bottom of a handle articulation connected to said handle.

15. A closure arrangement according to claim 13 wherein said handle is concave outwardly and includes vertical shoulders adapted to snap-receive an inset.

* * * * *